US005782160A

United States Patent [19]

Boone

[11] Patent Number: 5,782,160

[45] Date of Patent: Jul. 21, 1998

[54] ADJUSTABLE STOP FOR VARIABLE DISPLACEMENT PUMPS

[75] Inventor: Nick L. Boone, Omaha, Nebr.

[73] Assignee: Vickers, Incorporated, Maumee, Ohio

[21] Appl. No.: 864,246

[22] Filed: May 28, 1997

[51] Int. Cl.[6] ..... F01B 3/00

[52] U.S. Cl. ..... 92/12.2; 92/57; 91/505

[58] Field of Search ..... 92/57, 12.2, 71; 91/504, 505, 506

[56] References Cited

U.S. PATENT DOCUMENTS

| | | | |
|---|---|---|---|
| 1,428,876 | 9/1922 | Bollinckx | 91/504 |
| 2,935,063 | 5/1960 | Zubaty . | |
| 3,010,403 | 11/1961 | Zubaty . | |
| 3,198,129 | 8/1965 | Cameron-Johnson . | |
| 3,230,893 | 1/1966 | Hann et al. | 91/505 |
| 3,412,447 | 11/1968 | Summerfield . | |
| 3,676,020 | 7/1972 | Andreasen et al. . | |
| 3,982,470 | 9/1976 | Adams et al. . | |
| 4,037,521 | 7/1977 | McLeod | 92/57 |
| 4,168,653 | 9/1979 | Hein et al. . | |
| 5,184,536 | 2/1993 | Arai . | |
| 5,251,537 | 10/1993 | Hoshino et al. | 91/506 |
| 5,253,576 | 10/1993 | Bethke | 92/12.2 |

*Primary Examiner*—Thomas E. Denion
*Attorney, Agent, or Firm*—Jones, Day, Reavis & Pogue

[57] ABSTRACT

A hydraulic pump is disclosed having an adjusting member for varying yoke angle. The present adjusting member includes a control piston for displacing the yoke so as to define a desired yoke angle. A stop member is provided having threads and retained within the control piston. An adjusting screw for rotational motion is provided and includes an O-ring and a back up ring for sealing between the screw and the pump housing. The screw also includes a threaded portion for engaging the threads of the stop member. Rotation of the screw advances the threads while remaining stationary, displacing the control piston to limit the maximum inclination of the yoke.

14 Claims, 3 Drawing Sheets

ADJUSTABLE STOP FOR VARIABLE DISPLACEMENT PUMPS

BACKGROUND OF THE INVENTION

The present invention is directed to the field of pumps, particularly variable displacement hydraulic piston pumps that include an adjustable stop for varying fluid displacement. A hydraulic piston pump 10 according to the established design is shown in FIG. 1. The pump 10 includes a plurality of pistons 12 which are retracted to draw in hydraulic fluid from a supply source and are then compressed to discharge high-pressure hydraulic fluid into a discharge conduit. The pistons are concentrically retained within a cylinder block 14 which is rotationally displaced by a rotating coupling shaft 16. The end of each piston 14 is securely retained in mechanical engagement with a yoke 20. The yoke 20 is retained at an angle to the axis of rotation of the coupling shaft 16 and the cylinder block 14 (typically about 17.5 degrees). The yoke 20 can be pivotally adjusted to vary the angle of inclination. Upon rotation of the cylinder block 14, the pistons 12 are alternately pulled out and pushed in against the yoke 20.

The volume of hydraulic fluid transferred by each piston 12 is determined by the cross-sectional area of the piston and the length of each stroke. The stroke length, in turn, is determined by the radial distance of the piston 12 from the axis of rotation and also the inclination of the yoke 20 to the axis. The flow of hydraulic fluid is determined by the volume transferred by each piston, the number of pistons and the rate of rotation of the coupling shaft 16. In a common arrangement, as many as nine pistons are typically employed. During operation, all the pistons 12 are at different stages of intake and discharge, thus insuring a smooth and steady level of hydraulic flow. Most common hydraulic pumps supply pressure as high as 4640 psi.

In a variable displacement pump, flow is varied by changing the yoke angle between zero and a desired maximum. As shown in FIG. 2, an adjustable stop 30 abuts the yoke 20 and is used to set the yoke 20 of a desired angle, thus varying the yoke angle. In a common previous design, a stop 30 is adjusted by turning a threaded member 32 that extends from the pump housing 22. The threaded member limits the displacement of a control piston 34, which adjustably defines the yoke angle as the yoke 20 is urged into an inclined position by a biasing spring 24. Such stops 30 typically extend a great distance from the housing 22, and are variable in length as the stop 30 is displaced into and out of the housing. Thus, the previous stop 30 can protrude a large distance from the pump housing, thus prone to damage and creating a potential safety hazard. Also, this stop typically includes an O-ring seal 36 which displaces reciprocally with the stop during adjustment. Consequently, the displacement causes the pump 10 to tend to leak along the seal 36, also causing the seal 36 to wear out more quickly.

BRIEF SUMMARY OF THE INVENTION

Therefore, in view of the above-noted disadvantages and drawbacks with previous adjustable stops, there is therefore a need for an adjustable stop which does not significantly protrude from the pump housing.

There is also a need for an adjustable stop having a constant length extending externally from the pump housing.

There is also a need for an adjustable stop having a seal with reduced leaking.

There is also a need for an adjustable stop having a seal with longer operational life.

The above needs are satisfied by the present invention in which a hydraulic pump is disclosed having an adjusting member for varying yoke angle. The present adjusting member includes a control piston for displacing the yoke so as to define a desired yoke angle. A stop member is provided having threads and retained within the control piston. An adjusting screw for rotational motion is provided and includes an O-ring and a back up ring for sealing between the screw and the pump housing. The screw also includes a threaded portion for engaging the threads of the stop member. Rotation of the screw advances the threads while remaining stationary, displacing the control piston to limit the maximum inclination of the yoke.

The above and other needs which are satisfied by the present invention will become apparent from consideration of the following detailed description of the invention as is particularly illustrated in the accompanying drawings.

DETAILED DESCRIPTION OF THE INVENTION

Figure 1:
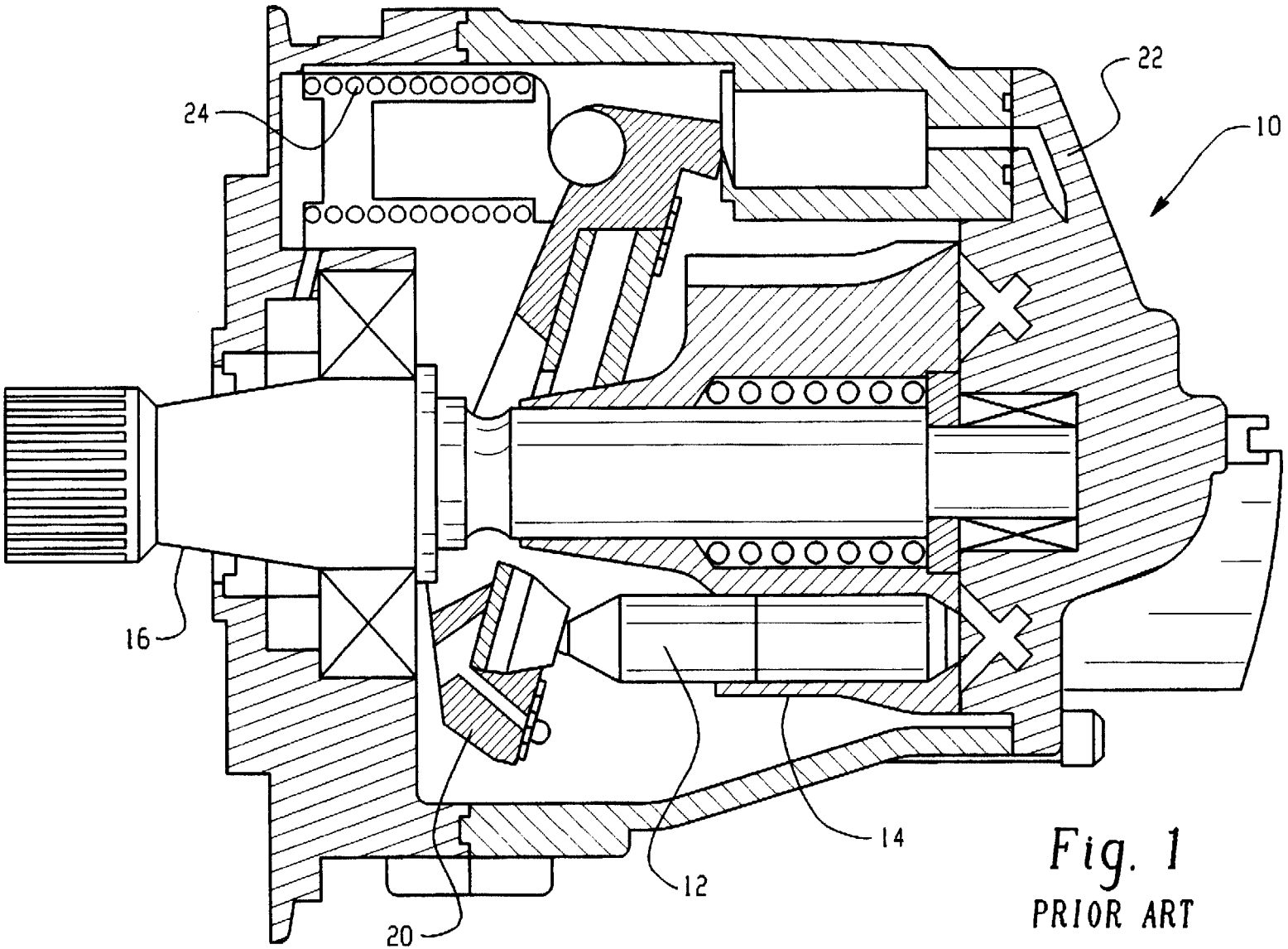
Fig. 1 PRIOR ART
FIG. 1 is a sectional view illustrating the configuration of a common hydraulic pump.
Figure 2:
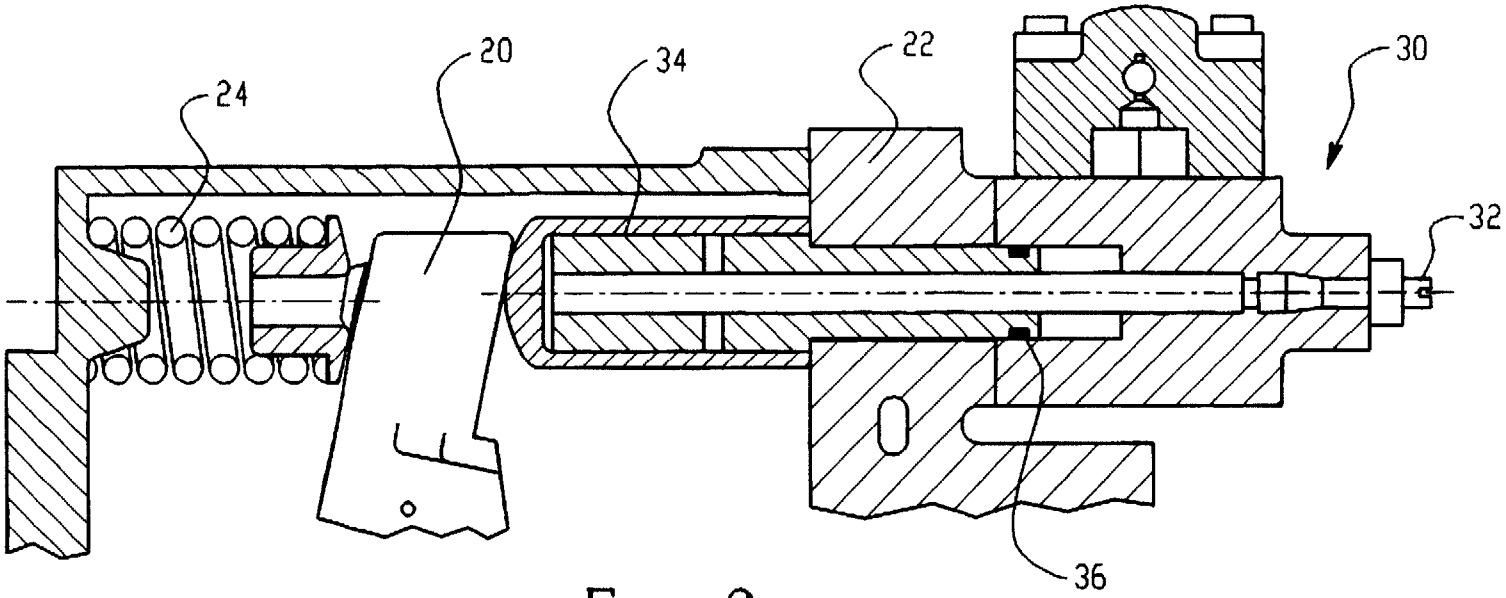
Fig. 2 PRIOR ART
FIG. 2 is a sectional view illustrating the operation of a previous adjustable stop for a hydraulic pump.
Figure 3:
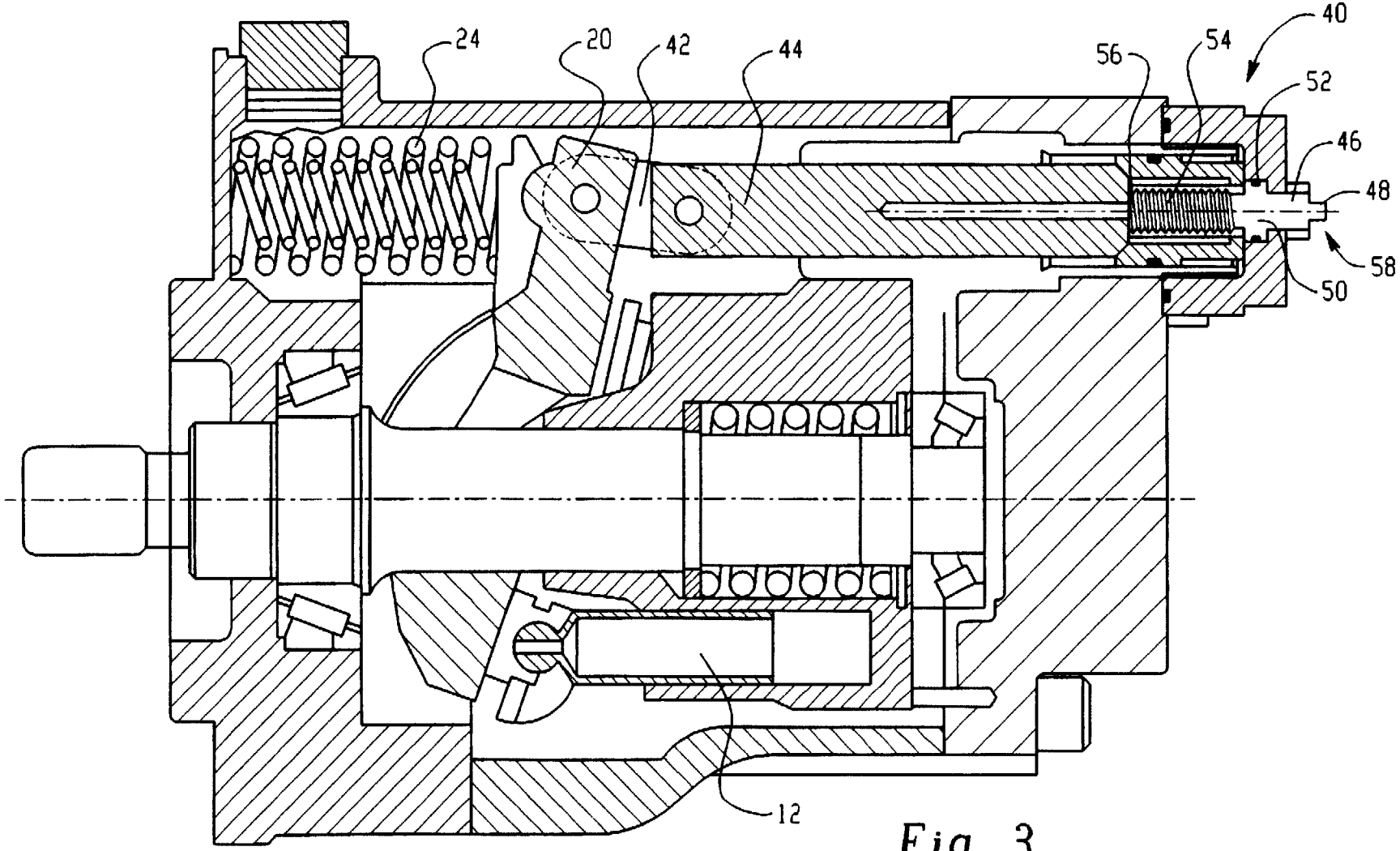
FIG. 3 illustrates a pump with an adjustable stop as according to the present invention.

The present invention solves the problems associated with previous systems by providing an adjustable stop 40 for a piston pump which is shorter and does not leak, as is the case with previous stop designs. In the current invention, the yoke 20 is biased toward an inclined position with a bias spring arrangement 24, as is also done with previous stop designs. A chain link 42 is used to connect the yoke 20 to a control piston 44, which limits the maximum inclination of the yoke 20 and prevents rotation of the control piston.

The position of the control piston 44 is varied with an adjusting screw 46 which is rotated at a head portion 48, which extends from the pump housing and is rotated using a wrench or the like. The screw 46 includes an integral oversized diametral section 50 which retains the screw 46 inside the pump housing. A groove 52 is provided to hold a rubber O-ring and back up ring, which is preferably a teflon washer. The O-ring and the back up ring form a seal between the adjusting screw and the housing. As the screw 46 is turned, the O-ring and back up ring rotate but do not move reciprocally back and forth. Thus, the seal of the present invention does not leak, as do previous stops, and does not wear out as quickly, having a longer operational life.

The screw 46 includes a threaded portion 54 which is threaded within the internal threads of a non-circular stop 56, preferably hexagonal. The hexagonal stop 56 is retained within a mating hexagonal cavity within the control piston 20, so as to preclude rotation of the stop 56. When the adjusting screw 46 is turned, the threaded portion 54 advances the hexagonal stop 56, which limits the maximum displacement of the control piston 44, thus limiting the inclination of the yoke angle. In this way, the present adjusting screw 46 permits variable adjustment without significantly protruding beyond the pump housing. Upon final adjustment, the adjusting screw 46 is secured in a desired position with a locking nut 58, which retains the screw 46 against rotation. In this way, the present invention provides an adjustable stop of constant length extending beyond the pump housing.

The foregoing description of the preferred embodiment has been presented for purposes of illustration and description. It is not intended to be limiting insofar as to exclude other modifications and variations such as would occur to those skilled in the art. Any modifications such as would occur to those skilled in the art in view of the above teachings are contemplated as being within the scope of the invention as defined by the appended claims.

I claim:

1. An adjusting member for limiting maximum yoke angle in a hydraulic pump, said adjusting member comprising:

a control piston for inclining a yoke so as to define a desired yoke angle;

a stop means having threads and retained within said control piston;

an adjusting screw for rotational motion comprising:

an oversized diametrical section for retaining said adjusting screw reciprocally stationary against a pump housing;

a threaded portion for engaging the threads of the stop means, wherein rotation of the adjusting screw advances the stop means, thereby displacing the control piston for inclining the yoke.

2. The adjusting member of claim 1 further comprising a chain link for connecting the control piston to the yoke and limiting rotation of the control piston.

3. The adjusting member of claim 1 wherein the stop member is non-circular and is retained within a bore in the control member.

4. The adjusting member of claim 1 wherein the threads of the stop member are internal threads.

5. The adjusting member of claim 1 wherein the adjusting screw further comprises a head portion, extending through the pump housing, and wherein the oversized diametral section cooperates with an O-ring and a back up ring to seal between the adjusting screw and the housing.

6. The adjusting member of claim 5 wherein the O-ring and back up ring are received within a groove along the circumferential perimeter of the adjusting screw.

7. The adjusting member of claim 5 wherein the head portion is retained by a lock nut.

8. A hydraulic pump having a housing comprising:

at least one piston for receiving and discharging fluid;

a yoke, inclined at a predetermined yoke angle, in order to displace the at least one piston to create hydraulic flow, wherein piston displacement and hydraulic flow are varied by varying yoke angle;

an adjusting member for varying yoke angle, said adjusting member comprising:

a control piston for inclining the yoke so as to define a predetermined yoke angle;

a stop means having threads and retained within said control piston;

an adjusting screw for rotational motion comprising:

an oversized diametrical section for retaining said adjusting screw reciprocally stationary against the pump housing;

a threaded portion for engaging the threads of the stop means, wherein rotation of the adjusting screw advances the stop means, thereby displacing the control piston for inclining the yoke.

9. The hydraulic pump of claim 8 further comprising a chain link for connecting the control piston to the yoke and preventing rotation of the control piston.

10. The hydraulic pump of claim 8 wherein the stop member is non-circular and is retained within a bore in the control member.

11. The hydraulic pump of claim 8 wherein the threads of the stop member are internal threads.

12. The hydraulic pump of claim 8 wherein the adjusting screw further comprises a head portion, extending through the pump housing, and wherein the oversized diametral section cooperates with an O-ring and a back up ring to seal between the adjusting screw and the housing.

13. The hydraulic pump of claim 12 wherein the O-ring and back up ring are received within a groove along the circumferential perimeter of the adjusting screw.

14. The hydraulic pump of claim 12 wherein the head portion is retained by a lock nut.

* * * * *